US009546552B2

(12) United States Patent
Schoenenborn

(10) Patent No.: US 9,546,552 B2
(45) Date of Patent: Jan. 17, 2017

(54) GAS TURBINE

(71) Applicant: MTU Aero Engines AG, Munich (DE)

(72) Inventor: Harald Schoenenborn, Karlsfeld (DE)

(73) Assignee: MTU Aero Engines AG, Munich (DE)

( * ) Notice: Subject to any disclaimer, the term of this patent is extended or adjusted under 35 U.S.C. 154(b) by 530 days.

(21) Appl. No.: 14/060,777

(22) Filed: Oct. 23, 2013

(65) Prior Publication Data

US 2014/0112769 A1 Apr. 24, 2014

(30) Foreign Application Priority Data

Oct. 24, 2012 (EP) ..... 12189768

(51) Int. Cl.
*F01D 9/00* (2006.01)
*F01D 5/18* (2006.01)
*F01D 5/16* (2006.01)

(52) U.S. Cl.
CPC . *F01D 5/18* (2013.01); *F01D 5/16* (2013.01); *F05D 2260/961* (2013.01); *Y10T 29/49316* (2015.01)

(58) Field of Classification Search
CPC ..... F01D 5/16; F01D 5/18; F05D 2260/961; Y10T 29/49316
See application file for complete search history.

(56) References Cited

U.S. PATENT DOCUMENTS 1,970,435 A * 8/1934 Sharp ..... F03B 3/06 29/889.21
2,916,258 A 12/1959 Klint
4,097,192 A * 6/1978 Kulina ..... F01D 5/16 416/175
4,878,810 A * 11/1989 Evans ..... F01D 5/16 416/175
5,286,168 A * 2/1994 Smith ..... F01D 5/16 416/193 A
6,042,338 A 3/2000 Brafford et al.
6,854,959 B2 * 2/2005 Barb ..... F01D 5/147 416/1
7,147,437 B2 * 12/2006 Burdgick ..... F01D 5/147 416/1
8,225,506 B2 * 7/2012 Chivers ..... F01D 5/147 264/261

(Continued)

FOREIGN PATENT DOCUMENTS

EP 1439281 7/2004
EP 2161411 3/2010

OTHER PUBLICATIONS

Abiud et al.:"An investigation into the effect of coolant flow on vibration characteristics of hollow blades conveying fluid", 28th ASME International Gas Turbine Conference, Phoenix, AZ, USA, Mar. 27 to 31, 1983, 7 pages.

(Continued)

*Primary Examiner* — Igor Kershteyn
(74) *Attorney, Agent, or Firm* — Davidson, Davidson & Kappel, LLC

(57) ABSTRACT

A gas turbine having a system of stages including at least one stage having first and second airfoils arranged alternately in the circumferential direction. The first airfoils each have a first array of cavities and the second airfoils each have a second array of cavities different from the first array of cavities.

19 Claims, 1 Drawing Sheet

(56) References Cited

U.S. PATENT DOCUMENTS

| | | | |
|---|---|---|---|
| 2002/0064458 | A1 | 5/2002 | Montgomery et al. |
| 2004/0151592 | A1 | 8/2004 | Schreiber |
| 2005/0129516 | A1 | 6/2005 | Rinck et al. |

OTHER PUBLICATIONS

Broufka et al.:"Insert damping of hollow airfoils," Proceedings of ASME Turbo Expo 2009: Power for Land, Sea and Air GT 2009, Jun. 8-12, 2009 Orlando, Florida, 6 pages.

* cited by examiner

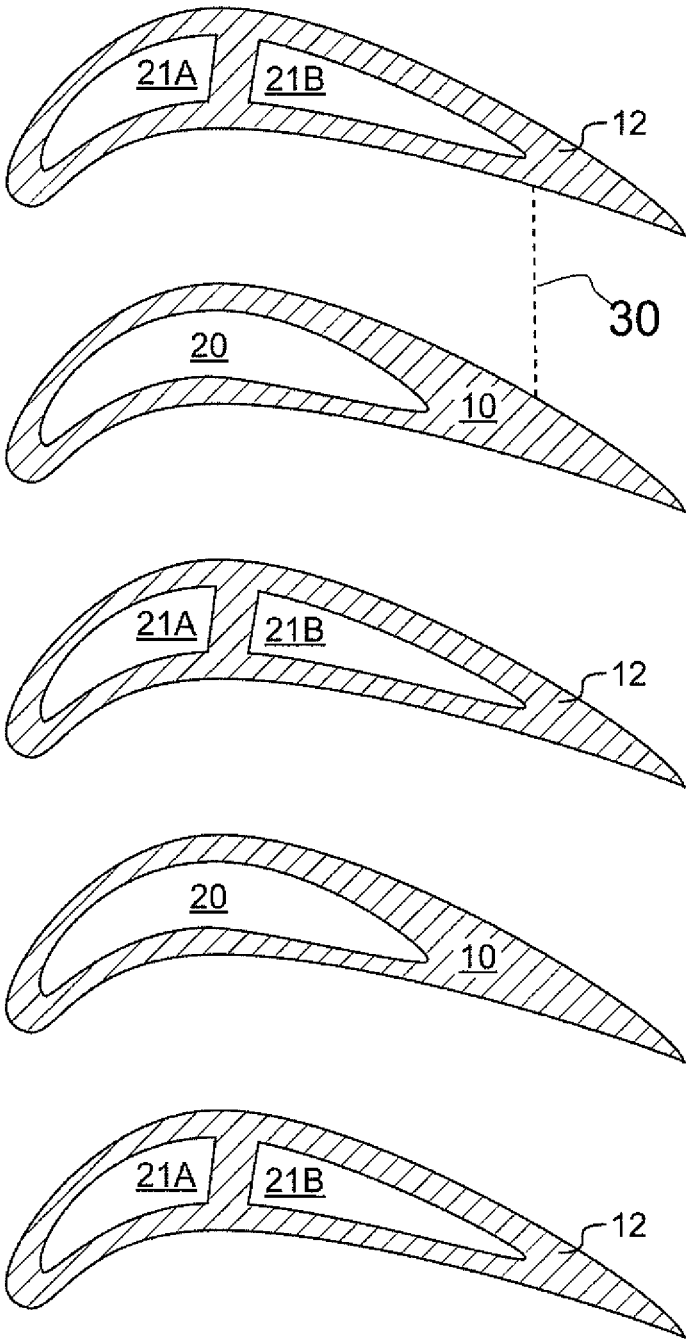
21A
21B
12
30
20
10
21A
21B
12
20
10
21A
21B
12

GAS TURBINE

This claims the benefit of European Patent Application EP 12 189 768.0-2321, filed Oct. 24, 2013 and hereby incorporated by reference herein.

The present invention relates to a gas turbine and a method for manufacturing such a gas turbine.

BACKGROUND

During the operation of gas turbines, so-called "airfoil flutter" can occur in the airfoils due to aeroelastic effects.

In this regard, U.S. Pat. No. 2,916,258 proposes a mistuned array of airfoils which all have different masses and thus different natural frequencies. In order to vary the masses, the airfoils may be formed as solid airfoils having different airfoil thicknesses, or as hollow airfoils having a central cavity, where the cavities of different airfoils differ in size.

SUMMARY OF THE INVENTION

It is an object of the present invention to provide an improved gas turbine, and specifically to reduce airfoil flutter in a gas turbine.

The present invention provides a gas turbine having a system of one or more stages, each of which has first and second airfoils arranged alternately in the circumferential direction.

One or more of these stages may be turbine stages for expanding gas. Specifically, one of these stages may be a high-pressure or low-pressure turbine stage. Additionally or alternatively, one or more of these stages may be compressor stages for compressing gas. Specifically, one of these stages may be a high-pressure or low-pressure compressor stage.

The first and second airfoils may in particular be rotor-mounted blades and/or stator-or casing-mounted vanes. Thus, a gas turbine according to the present invention may in particular have a (high-pressure or low-pressure) turbine stage having first and second turbine rotor blades. Additionally or alternatively, this or another (high-pressure or low-pressure) turbine stage may have first and second turbine stator vanes. Additionally or alternatively, a gas turbine according to the present invention may have a (high-pressure or low-pressure) compressor stage having first and second compressor rotor blades. Additionally or alternatively, this or another (high-pressure or low-pressure) compressor stage may have first and second compressor stator vanes.

One or more of these stages have first and second airfoils. In an embodiment, one or more of these stages is/are composed of first and second airfoils; that is, does/do not have third airfoils having a different array of cavities. Accordingly, "alternately arranged first and second airfoils" are understood to be in particular an array in which each first airfoil has an immediately adjacent second airfoil on both sides thereof, and each second airfoil has an immediately adjacent first airfoil on both sides thereof, with the possible exception of a pair of immediately adjacent first airfoils or immediately adjacent second airfoils in a stage whose total number of airfoils is odd. An array of airfoils having only two alternately arranged types of airfoils in one stage has surprisingly turned out to be particularly advantageous, in particular for reducing airfoil flutter.

In a refinement, rotor blade arrays of different turbine and/or compressor stages, in particular of adjacent ones or ones which are spaced apart by at least one further stage, and/or stator vane arrays of these or different turbine and/or compressor stages, in particular of adjacent ones or ones which are spaced apart by at least one further stage, may each have alternately arranged first and second airfoils, in particular to further reduce airfoil flutter.

The first (stator and/or rotor) airfoils each have a first array of cavities, and the second (stator and/or rotor) airfoils each have a second array of cavities different from the first array of cavities.

By providing different arrays of cavities in adjacent, alternately arranged airfoils, it is possible to vary their stiffness distribution and/or mass distribution, and thus, in particular, their eigenmodes; i.e., their modes of vibration, and to mistune them with respect to one another, in particular in the case of airfoils of identical total mass. In particular, in an embodiment, first and second airfoils having at least substantially identical or similar natural frequencies may have different eigenmodes, so that pressure perturbations induced by the vibrating airfoils are different and propagate differently in the flow.

Additionally or alternatively, their natural frequencies may also be varied and mistuned with respect to one another, In particular, in an embodiment, a first natural frequency, in particular the first natural bending frequency, of the first airfoils may differ by at least 2%, in particular by at least 3%, from a first natural frequency, in particular the first natural bending frequency, of the second airfoils. Additionally or alternatively, in an embodiment, this first natural frequency of the first airfoils may differ by no more than 9%, in particular by no more than 8%, from this first natural frequency of the second airfoils. An array of airfoils having such natural frequency differences has surprisingly turned out to be particularly advantageous, in particular for reducing airfoil flutter.

The first and second arrays of cavities may differ, in particular, in the number of cavities. In particular, one (the first/second) of the arrays of cavities may have no cavity (i.e., one type of (the first/second) airfoils may be solid), or may have one or two cavities. In an embodiment, the other (the second/first) of the arrays of cavities may in particular have one or more cavities more than the aforementioned (first/second) one of the arrays of cavities, that is, in particular, one cavity when the aforementioned (first/second) one of the arrays of cavities has no cavity, two cavities when the aforementioned (first/second) one of the arrays of cavities has one cavity, or three cavities when the aforementioned (first/second) one of the arrays of cavities has two cavities. The cavity or cavities may extend in particular at least substantially parallel to a stacking axis of the particular airfoil. Two or more cavities of an array of cavities may communicate with one another over a limited radial length, in particular at the cavity ends near the airfoil tip and/or at the cavity ends near the airfoil root. A "cavity" in the context of the present invention is defined in particular by a closed peripheral contour in at least one developed section; i.e., a section at a radial height of an airfoil, and is distinguished from one or more further cavities of this airfoil, which accordingly then has a plurality of cavities in accordance with the present invention.

In an embodiment, the first and second arrays of cavities may have at least substantially the same volume. To this end, in an embodiment, the sum of the cross-sectional areas; i.e., the total cross-sectional area of all cavities of the first array of cavities in all developed sections; i.e., sections at all radial heights of an airfoil may in particular be at least substantially equal to the sum of the cross-sectional areas; i.e., the total cross-sectional area of all cavities of the second array of cavities in these developed sections. However, identical volumes may also be obtained by cavities having different cross-sectional areas or contours in at least one developed section in that the cavities have different extents in the longitudinal or stacking direction of the airfoil and/or in that the difference in cross-sectional area is compensated at a different radial height.

Additionally or alternatively, the first and second airfoils may have at least substantially the same weight. This can be achieved, in particular, by the above-described identical total volumes, and thus identical amounts of missing solid material, but also by different airfoil materials at least in some portions thereof.

Two cavities of an array of cavities may have different shapes, in particular non-congruent contours in at least one developed section; i.e., a section at a radial height of an airfoil. Additionally or alternatively, a cavity of one (the first/second) of the arrays of cavities and a cavity of the other (the second/first) of the arrays of cavities that corresponds to the aforementioned cavity in its relative position with respect to the airfoil may have different shapes, in particular non-congruent contours in at least one developed section; i.e., a section at a radial height of an airfoil. Generally, leading edge-proximate cavities of the first array of cavities and trailing edge-proximate cavities of the first array of cavities and/or leading edge-proximate cavities of the second array of cavities may have different shapes.

In an embodiment, the first and second airfoils may be joined together by a material-to-material bond, in particular by welding, or formed together by primary or secondary shaping. In particular, the first and second airfoils may form a so-called "blisk" (integrally bladed disk).

In an embodiment, the first and/or second arrays of cavities may be formed together with the respective airfoils by primary shaping. In particular, the airfoils may be cast, and the arrays of cavities may be defined by cores. In an embodiment, the first and/or second airfoils are produced generatively, in particular by locally solidifying material layer by layer, in particular optically, thermally and/or chemically. This makes it possible to produce more complex, in particular hermetically sealed arrays of cavities.

The first and/or second arrays of cavities may also be produced after the airfoils are formed by primary shaping. More particularly, the first and/or second arrays of cavities may be produced by removal and/or elimination of material, preferably by machining or vaporization.

In an embodiment, the arrays of cavities, in particular their shapes, their arrangement within the airfoils and/or their volumes, are matched to reduce airfoil flutter compared to a stage having at least two adjacent blades having either the first or second array of cavities. This may be done, in particular, by simulation and/or experimentally.

Further advantages and features will become apparent from the dependent claims and the exemplary embodiment.

BRIEF DESCRIPTION OF THE DRAWING

To this end, the only drawing, FIG. 1, shows a portion of a gas turbine stage having first and second airfoils arranged alternately in the circumferential direction in accordance with an embodiment of the present invention.

DETAILED DESCRIPTION

FIG. 1 is a developed section; i.e., a section at a constant radial height of a stage of a gas turbine according to an embodiment of the present invention. The stage may in particular be a turbine or compressor stage, The stage has first airfoils 12 and second airfoils 10 which are arranged alternately in the circumferential direction (vertically in FIG. 1) and whose outer contours are at least substantially identical. Airfoils 10, 12 may in particular be rotor-mounted blades and/or stator-or casing-mounted vanes.

Second airfoils 10 each have a second array of cavities, each array having one cavity 20 which is parallel to a stacking axis of airfoil 10 and may in particular be in alignment therewith.

First airfoils 12 each have a first array of cavities which is different from the second array of cavities and which includes two cavities 21A, 21B which, in the sectional view of FIG. 1, are separated from each other. In an embodiment, they may communicate with one another in a section at a different radial height. The may also be sealed off, especially in an embodiment where the airfoils are produced generatively, so that the first and second arrays of cavities are formed together with the airfoils by primary shaping.

Thus, the first and second arrays of cavities have different numbers of cavities. Nevertheless, the first and second arrays of cavities have at least substantially the same volume. In the sectional view of FIG. 1, they have in particular the same total cross-sectional area; that is, the cross-sectional area of cavity 20 is at least substantially equal to the sum of the cross-sectional areas of cavities 21A, 21B; the extents of cavities 20, 21A, 21B in a radial direction (in a direction perpendicular to the plane of the paper of FIG. 1) also being at least substantially equal. In an embodiment, the cavities of the first and second arrays of cavities may also have different total cross-sectional areas in at least one developed section. This may be compensated in other developed sections and/or by the radial extents of the cavities in order to obtain at least substantially equal volumes for the first and second arrays of cavities.

Since the first and second airfoils are otherwise substantially equal in configuration, in particular in their outer contour and material, the have at least substantially the same weight.

It can also be seen in FIG. 1 that leading edge-proximate cavity 21A of the first array of cavities and trailing edge-proximate cavity 21B of the first array of cavities have different shapes. Similarly, leading edge-proximate cavity 21A of the first array of cavities and leading edge-proximate cavity 20 of the second array of cavities also have different shapes.

The arrays of cavities are matched to reduce airfoil flutter compared to a stage having at least two adjacent blades having either the first or second array of cavities. To this end, the first natural bending frequency of first airfoils 12 differs by 5%, from the first natural bending frequency of second airfoils 10.

In an embodiment, the first and second airfoils may be joined together by a material-to-material bond, shown schematically as weld 30, in particular by welding, or formed together by primary or secondary shaping.

LIST OF REFERENCE NUMERALS

10 second airfoils
12 first airfoils
20 second cavities
21A, 21B first cavities
30 bond

What is claimed is:

1. A gas turbine having a system of stages comprising:

at least one stage having first and second airfoils arranged alternately in the circumferential direction, wherein the first airfoils each have a first array of cavities and the second airfoils each have a second array of cavities different from said first array of cavities, wherein the first and second airfoils have at least substantially the same weight.

2. The gas turbine as recited in claim 1 wherein the system of stages is a system of turbine stages for expanding gas or a system of compressor stages for compressing gas.

3. The gas turbine as recited in claim 1 wherein the first and second airfoils are rotor blades or stator vanes.

4. The gas turbine as recited in claim 1 wherein a first natural frequency of the first airfoils differs by at least 2% or by no more than 9% from a first natural frequency of the second airfoils.

5. The gas turbine as recited in claim 4 wherein the first natural frequency of the first airfoils differs by no more than 8% from the first natural frequency of the second airfoils.

6. The gas turbine as recited in claim 4 wherein the first natural frequency of the first airfoils differs by at least 3% from the first natural frequency of the second airfoils.

7. The gas turbine as recited in claim 4 wherein the first natural frequency of the first airfoils differs by at least 2% and by no more than 9% from the first natural frequency of the second airfoils.

8. The gas turbine as recited in claim 1 wherein the first and second arrays of cavities have different numbers of cavities.

9. The gas turbine as recited in claim 1 wherein the first and second arrays of cavities have a similar volume.

10. The gas turbine as recited in claim 1 wherein leading edge-proximate cavities of the first array of cavities and trailing edge-proximate cavities of the first array of cavities or leading edge-proximate cavities of the second array of cavities have different shapes.

11. The gas turbine as recited in claim 1 wherein the first and second airfoils are joined together by a material-to-material bond.

12. The gas turbine as recited in claim 11 wherein the bond is generatively-produced bond.

13. The gas turbine as recited in claim 1 wherein the first or second arrays of cavities are formed together with the airfoils by primary shaping or produced after the airfoils are formed by primary shaping.

14. A method for manufacturing the gas turbine as recited in claim 1 comprising matching the first and second arrays of cavities to reduce airfoil flutter compared to a stage having at least two adjacent blades having either the first or second array of cavities.

15. A gas turbine having a system of stages comprising:

at least one stage having first and second airfoils arranged alternately in the circumferential direction, wherein the first airfoils each have a first array of cavities and the second airfoils each have a second array of cavities different from said first array of cavities, wherein leading edge-proximate cavities of the first array of cavities and trailing edge-proximate cavities of the first array of cavities or leading edge-proximate cavities of the second array of cavities have different shapes.

16. A gas turbine having a system of stages comprising:

at least one stage having first and second airfoils arranged alternately in the circumferential direction, wherein the first airfoils each have a first array of cavities and the second airfoils each have a second array of cavities different from said first array of cavities, wherein each first airfoil has at least two first cavities of the first array of cavities, and each second airfoil has a different number of cavities of the second array of cavities than two.

17. The gas turbine system as recited in claim 16 wherein each second airfoil has a single cavity of the second array of cavities.

18. The gas turbine as recited in claim 16 wherein the two first cavities are separated by a material bridge extending from a suctions side to a pressure side of the first airfoils.

19. A gas turbine having a system of stages comprising:

at least one stage having first and second airfoils arranged alternately in the circumferential direction, wherein the first airfoils each have a first array of cavities and the second airfoils each have a second array of cavities different from said first array of cavities, wherein the first and second arrays of cavities have a same volume.

* * * * *